US005158272A

United States Patent [19]

Biervert et al.

[11] Patent Number: 5,158,272

[45] Date of Patent: Oct. 27, 1992

[54] WORK TABLE HAVING A METALLIC CUTTING BASE FOR AN AUTOMATIC FLUID JET CUTTING INSTALLATION

[75] Inventors: Klaus Biervert, Spenge; Wolfgang Bruder, Bielefeld; Gerd Kupper, Bad Salzuflen; Gerald Hess, Bielefeld, all of Fed. Rep. of Germany

[73] Assignee: Dürkopp Adler AG, Fed. Rep. of Germany

[21] Appl. No.: 501,158

[22] Filed: Mar. 29, 1990

[30] Foreign Application Priority Data

Mar. 30, 1989 [DE] Fed. Rep. of Germany ..... 3910273

[51] Int. Cl.[5] ..... B26D 7/01

[52] U.S. Cl. ..... 269/21; 83/648; 83/941

[58] Field of Search ..... 83/177, 58, 648, 658, 83/936, 941; 269/21

[56] References Cited

U.S. PATENT DOCUMENTS

| | | | |
|---|---|---|---|
| 3,626,800 | 12/1971 | Newton, Jr. et al. | 83/658 |
| 4,112,797 | 9/1978 | Pearl | 83/177 |
| 4,143,573 | 3/1979 | Reichert | 83/658 |
| 4,269,549 | 5/1981 | Block | 408/1 R |
| 4,312,254 | 1/1982 | Pearl | 83/177 |
| 4,685,363 | 8/1987 | Gerber | 83/22 |

FOREIGN PATENT DOCUMENTS

| | | | |
|---|---|---|---|
| 2502542 | 7/1976 | Fed. Rep. of Germany | 83/658 |

*Primary Examiner*—Mark Rosenbaum
*Assistant Examiner*—John M. Husar
*Attorney, Agent, or Firm*—Ostrolenk, Faber, Gerb & Soffen

[57] ABSTRACT

A work table for an automatic cutting installation for cutting materials by means of non-mechanical cutting tools has a metallic cutting base which is formed of a plurality of metal strips. Edges of the metal strips form the support surface for the workpiece. Undulating metal strips may be arranged alternately against non-undulating metal strips. Alternatively, metal strips may be used that are bent into the form of a rectangular undulation and have undulation valleys and undulation ridges which are of different length. The undulation valleys and undulation ridges lie in each case opposite each other and offset, forming a corner-shaped space. The metal strips extend over the complete width of the work table and their top-to-bottom width is selected to provide sufficient stability for the material to be cut which rests thereon. Portions of the metal strips are bonded or soldered to each other.

19 Claims, 9 Drawing Sheets

WORK TABLE HAVING A METALLIC CUTTING BASE FOR AN AUTOMATIC FLUID JET CUTTING INSTALLATION

BACKGROUND OF THE INVENTION

The present invention relates to a work table having a metallic cutting base for an automatic cutting installation, particularly a very-high-pressure fluid-jet cutting installation, on which materials are cut by means of non-mechanical cutting tools. It relates more particularly to a metallic cutting base which has an interrupted top surface.

Federal Republic of Germany AS 28 13 498 discloses a device for cutting a stack of flat material with a jet of fluid. The disclosure of this and all other prior art materials mentioned herein is incorporated by reference. The cutting base of this cutting device consists of thin support plates which are vertical and parallel to each other and have a cutting-edge-like surface. Such a honeycomb-shaped support-plate structure is conventionally known, for instance, by the name of "honeycomb" and can be easily produced from aluminum.

The wall thickness of these support plates must be as thin as possible in order to avoid splattering the impinging jet of water and thus wetting the material being cut. Because of the high energy inherent in a jet of fluid, a cutting base of aluminum is subjected to very extensive wear, so that, for reasons of economy, it cannot be used in the textile or leather-working industries where such cuts are carried out frequently one after another and the numerically controlled cutting jet is moved continuously over the same places.

It is not possible with practical manufacturing techniques to produce such a honeycomb structure from steel plate. The wall thickness obtainable by stamping or boring is not sufficiently thin to avoid back-splashing effects.

SUMMARY OF THE INVENTION

The main object of the invention is therefore to develop a work table of this type with a cutting base that has a long life, dependably and effectively prevents back-splash effects and, at the same time, is simple and inexpensive to manufacture.

This object may be attained by forming the cutting base of individual metal strips arranged one alongside the other. Upper edges of undulating metal strips and non-undulating metal strips lying alternately against each other may form the top surface of the cutting base.

As a result of this construction, it is possible, in a simple manner, to obtain passage openings of any desired size to carry the fluid away into the collection pan of the work table, since this size is dependent solely on the shape of the undulations of the metal strips.

Alternatively, all the metal strips may have undulations. Metal strips which are bent in the form of a rectangular undulation may be used exclusively. A corner-shaped open area comprising a ridge and a valley may be formed by such strips, the length of an undulation ridge differing from the length of an undulation valley.

The respective undulation ridges of two adjacent undulating strips may be offset with respect to each other. This structure has the advantage of permitting metal strips of only one type to be used and also increasing the resting surface area between the individual strips.

Each undulating metal strip is preferably attached, bonded or soldered at its undulation ridges to an adjacent undulating or non-undulating metal strip.

In the above cutting bases, the metal strips may be supported on bolts. These bolts are preferably arranged on outer struts forming the longitudinal sides of the cutting base, at the points of intersection of longitudinal and transverse struts of a grid, and extend upward above the grid. This development permits the simple replacement of any metal strips which may have become damaged.

Advantageously, each undulating metal strip rests against the adjacent bolts with the latter surrounded by an undulation valley of the metal strip.

Preferably, at least one type of the metal strips has holes spaced along it in its lengthwise direction. This improves drainage from the cutting base due to the capillary action of the holes.

In the X direction, perpendicular to the lengthwise direction of the metal strips, a continuously acting compressive stress may be applied to the cutting base. The cutting base may be drilled with holes and the compressive stress can be applied by a screw connection or tie bolt which extends in the X direction. Alternatively or in addition, tension devices which are arranged in the cutting base and protrude in the lengthwise direction of the metal strips at the edges of the cutting base can apply a tensile stress in the Y direction, longitudinally of the metal strips. The stability of the cutting base is increased by these features.

Perpendicular to the lengthwise direction of the metal strips, the edges of the cutting base may be grouted with a synthetic resin. This feature prevents fraying or coming apart of the surface of the cutting base in the event that, after lengthy use, the connecting places between the individual strips should become separated.

According to a particularly useful aspect of the invention, the cutting base may be arranged so that the longitudinal direction of the metal strips extends at an angle other than a right angle to the edges of the work table as a whole. By this feature, the life of the cutting base can be increased. Since the cutting tool is limited to moving only in the given X and Y directions, only cuts in these directions can be effected. Even if the step movements of the tool are made very small, they cannot be exactly in the main direction of the cutting base, so the cutting jet will impinge less frequently on the places of abutment between any two metal strips.

BRIEF DESCRIPTION OF THE DRAWINGS

Other objects, features and advantages of the invention will be understood from the following detailed description of several embodiments thereof, with reference to the drawings, in which.

DETAILED DESCRIPTION

Figure 1:
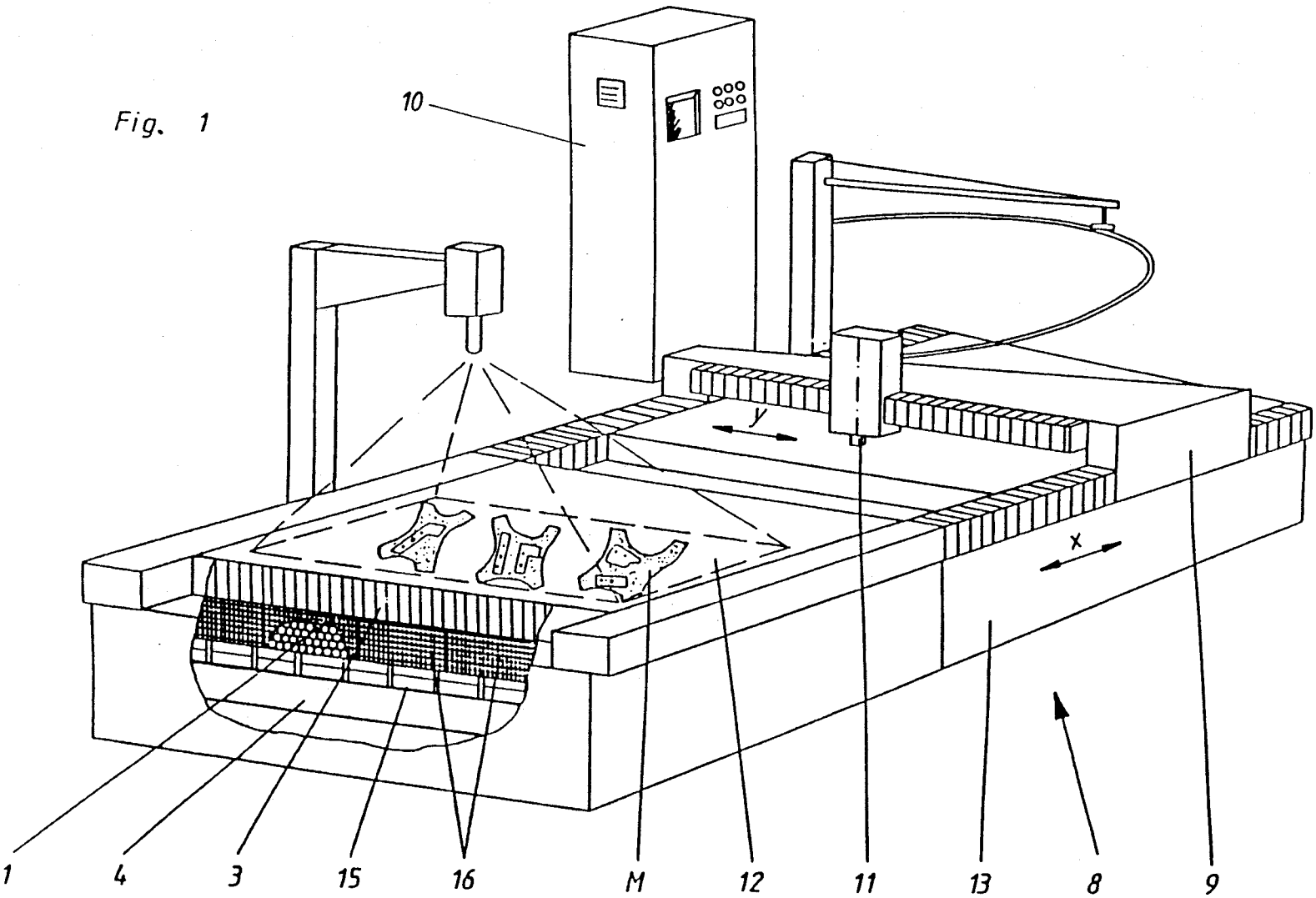
FIG. 1 shows an automatic fluid-jet cutting installation, seen in perspective and partially cut-away.
Figure 1A:
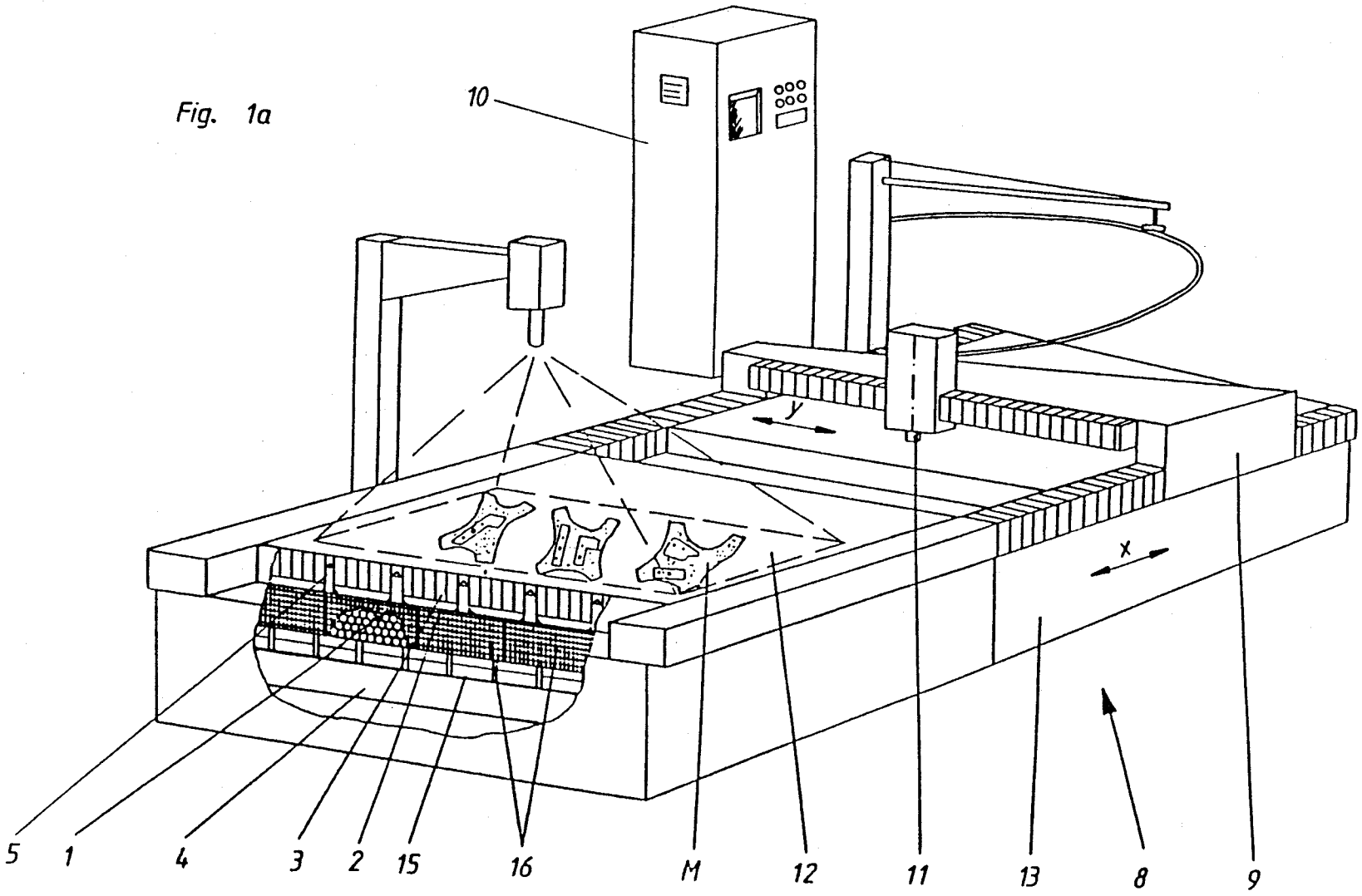
FIG. 1*a* shows a modification of FIG. 1.

FIGS. 1 and 1*a* each show an example of a numerically controlled, very-high-pressure fluid-jet cutting installation in partially simplified form, including the work table 8, the cutting base 3 which is arranged on the work table 8, the cutting gantry 9 which receives the high-pressure nozzle 11 and is mounted for longitudinal (direction X) displacement over the work table 8, and the control installation 10. Identical parts have been provided with the same reference numbers for the sake of simplicity.

The material 12 which is to be cut is placed on the cutting base 3 and the individual patterns M are cut out by means of the fluid jet flowing through the high-pressure nozzle 11. The nozzle 11 is mounted for transverse (direction Y) movement on the cutting gantry 9.

Figure 2:
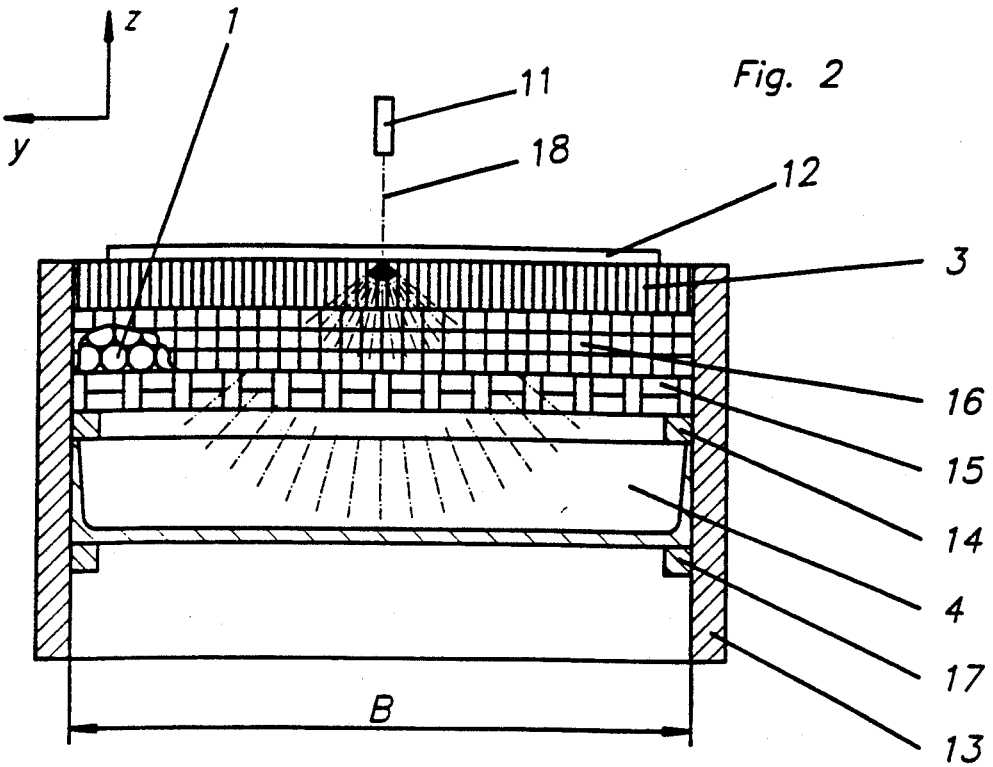
FIG. 2 is a cross-section through the work table of the fluid-jet cutting installation of FIG. 1, in a simplified view.
Figure 2A:
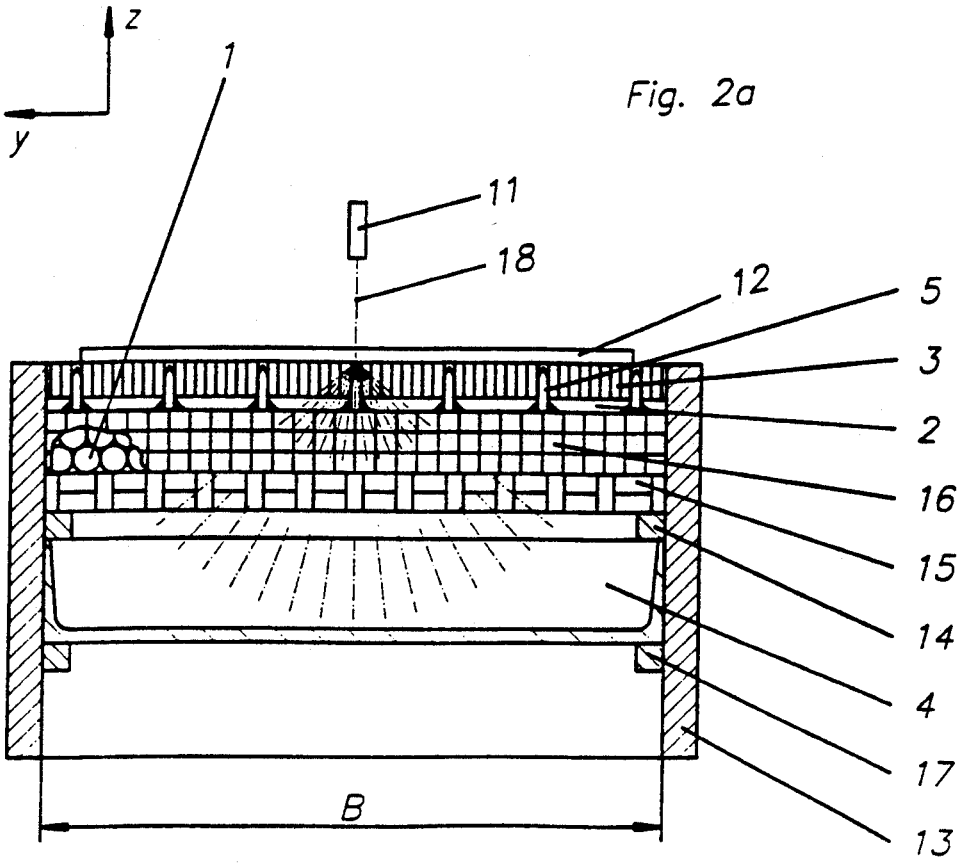
FIG. 2*a* shows a cross-section through the work table of the fluid-jet cutting installation of FIG. 1*a*, in a simplified view.

FIGS. 2 and 2*a* are cross-sectional views taken along a plane in the vertical (Z) direction and show details of the construction of the work table 8 in FIGS. 1 and 1*a*, respectively.

The work table 8 has a rectangular, surrounding, laterally closed frame 13. Within this frame 13 there are arranged struts 17 which support a collecting pan 4 which forms the bottom of the work table 8 and in which the cutting fluid collects after cutting. Above the collecting pan 4, ordinary commercial grids 15 consisting of longitudinal and transverse struts which are welded together rest on the inward protruding flanges 14 which are provided on the frame 13. These grids 15 serve as a support for the cutting base 3 and are arranged at such a height within the frame 13 that sufficient space remains between them and the bottom of the collecting pan 4 in order to effectively discharge the spent cutting fluid. Over the grids 15 is placed at least one single-layer covering 1 of a granulate material enclosed in cages 16, and the cutting base 3 lies on these cages 16. Further grids 2 can be arranged between the cages 16 and cutting base 3, as shown in FIG. 1*a*.

The construction of one known work table is described, for instance, in Federal Republic of Germany C 3,840,072.

Several forms and details of the metallic cutting base 3 are shown in FIGS. 3–14. In each case, the metallic cutting base 3 comprises a plurality of strips 3*a*, 3*b* (or 3*c*) of steel plate which are fastened, bonded or soldered to each other.

Referring first to FIGS. 3–11, a first undulating metal strip 3*a* is located between and connected alternately to a pair of second, non-undulating strips 3*b*. Instead of an undulating curved metal strip the first strip can also be a strip bent with sharp edges, for example triangularly, or may be bent into the form of a rectangular undulation.

Each of the strips 3*a*, 3*b* has a length which corresponds to the width B of the work table.

The thickness of the material of each metal strip 3*a*, 3*b* is less than substantially 1/10 millimeter; it has been found to be very advantageous if stainless steel of a thickness of 0.07 mm is used. In order to increase the life of the cutting base 3, the metal strips 3*a*, 3*b* can be hardened in a known manner. The top-to-bottom width of the strips may be any desired width The width of the strips 3*a*, 3*b* is dependent on the desired or necessary thickness D (FIG. 7) of the cutting base 3 which, in its turn, is dependent on the material 12 to be cut which is placed thereon. In practice, a strip width of about 20 mm has proven satisfactory for cutting flexible materials such as textiles or leather As many metal strips as are required in view of the length of the work table 8 are bonded together. In the figures only two strips 3*a*, 3*b* are shown by way of example in each case, arranged one behind the other, in order to make the principle of the arrangement clear. A further increase in stability is obtained if the metal strips 3*a*, 3*b* are connected to each other by brazing.

Figure 8:
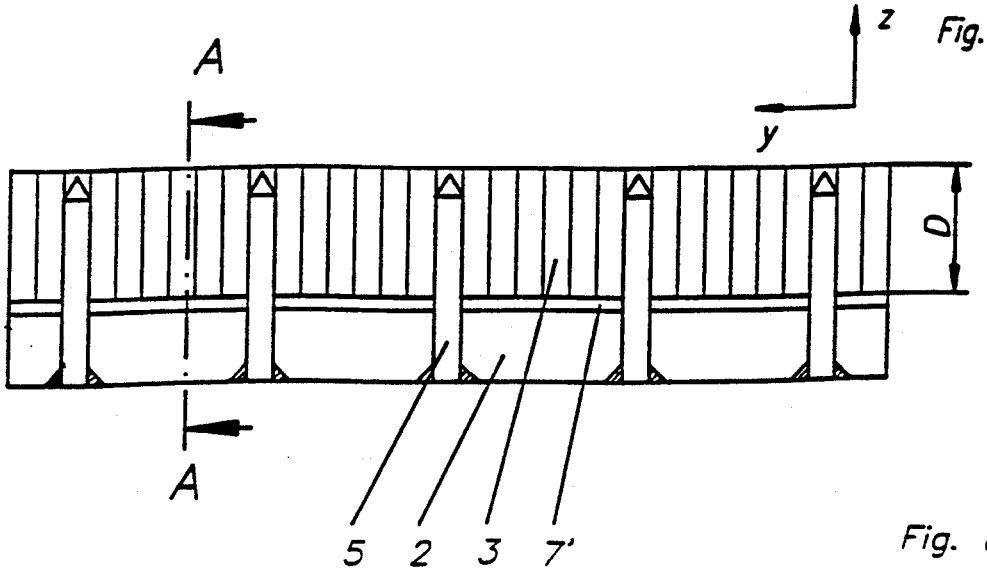
FIG. 8 shows another embodiment of the cutting base, in side view.
Figure 9:
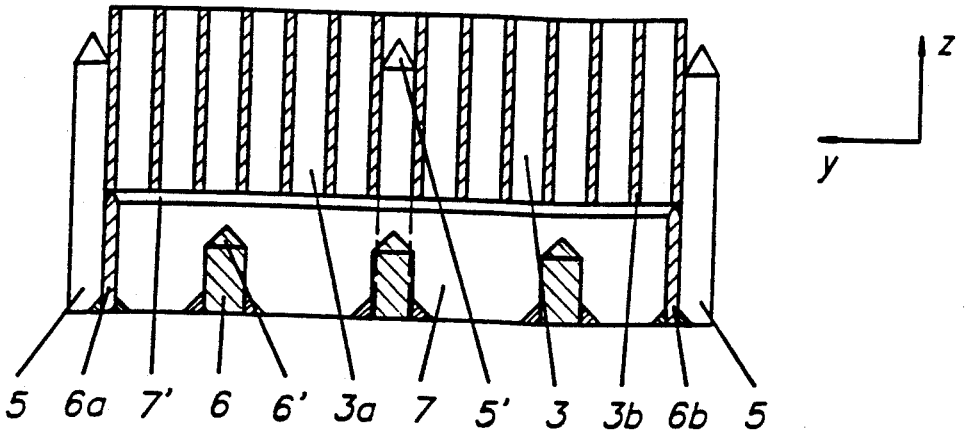
FIG. 9 is a cross-section through the cutting base, taken along line A—A in FIG. 8.

In the modified embodiment of FIGS. 1*a*, 2*a* the cutting base 3 is arranged on a second grid 2 which rests on the granulate-filled cages 16. Referring particularly to FIGS. 8 and 9, the grid 2 comprises longitudinal struts 6 and transverse struts 7 which are welded to each other. Vertically upward extending bolts 5 are welded to the outsides of the outer struts 6*a*, 6*b* forming the longitudinal sides, at each of the points of intersection of the longitudinal and transverse struts 6*a*, 6*b*, 7. The upward extending top edges 6', 7' of the struts 6, 7 are ground so that they terminate in an acute angle; the same is true of the ends of the bolts 5.

The inner longitudinal struts 6 have a smaller height than the transverse struts 7 (see FIG. 9).

Figure 10:
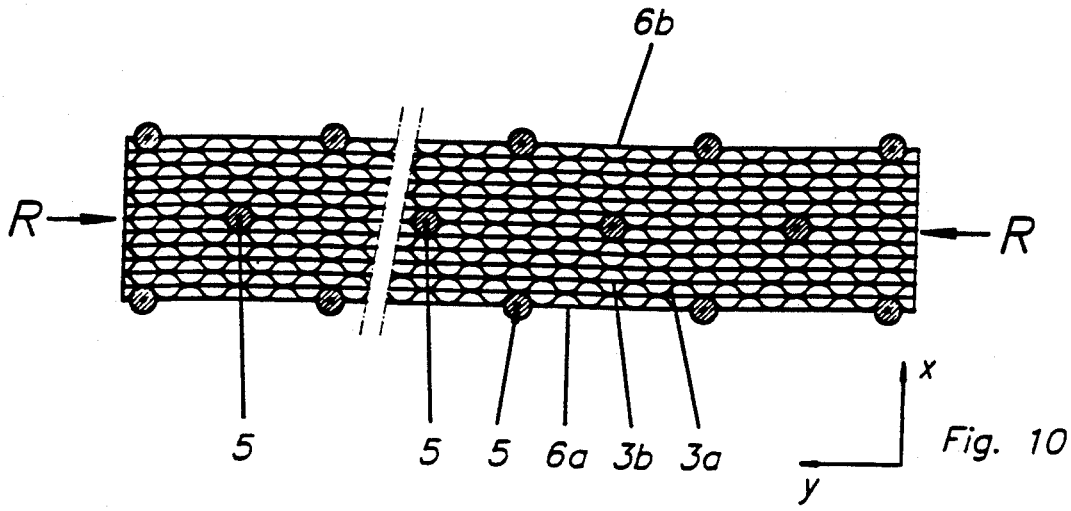
FIG. 10 is a partial top view of the cutting base of FIG. 8.

The cutting base 3 is constructed on the grid 2 by assembling together undulating metal strips 3*a* alternating with non-undulating metal strips 3*b*. In each case, a sufficient number of metal strips 3*a*, 3*b* are firmly packed against each other for the grid 2 to be completely covered The metal strips 3*a*, 3*b* are placed on the transverse struts 7. Referring particularly to FIG. 10, the assembly process advantageously commences and terminates by placing an undulating strip 3*a*, with the undulation valleys T coinciding with the bolts 5. Due to the compressive force acting in the transverse direction of the metal strips 3*a*, 3*b* (direction X) and the friction between the metal strips 3*a*, 3*b* acting in longitudinal direction of the metal strips (direction Y), the cutting base is stable in shape.

It is possible to magnetize the grid 2 so that the metal strips 3*a*, 3*b*, 3*c* (FIGS. 12–14), are held in addition by magnetic forces.

The length of the bolts 5 is selected so that they do not extend above the cutting base 3 and preferably are even recessed beneath it.

Over the length of the work table 8, the cutting base 3 is divided into a plurality of individual segments, i.e.

several packed grids 2 are arranged one behind the other. Each segment may possibly contain, for instance, 50 metal strips 3*a*, 3*b*. This facilitates handling and access to the inside of the work table 8.

In order, on the one hand, to facilitate the packing of the cutting base 3 and, on the other hand, to increase the stability of the packed cutting base 3, additional bolts 5 can be arranged at other points of intersection of longitudinal and transverse struts 6, 7 in the inner region of the grid 2 (see FIG. 10).

The undulating strips 3*a* may be produced in known manner by rolling between two gear wheels. The combination of pitch and diameter of the gear wheels is selected as a function of the desired size of the openings in the cutting base 3. A large pitch leads to a fine-pore surface and a small pitch to a large-pore surface. The desired size of the openings is dependent, on the one hand, on the material to be cut, since with a large-pore surface there are fewer resting places for the material 12. On the other hand, the opening size depends on how rapidly the fluid must be removed from the work surface.

Figure 5:
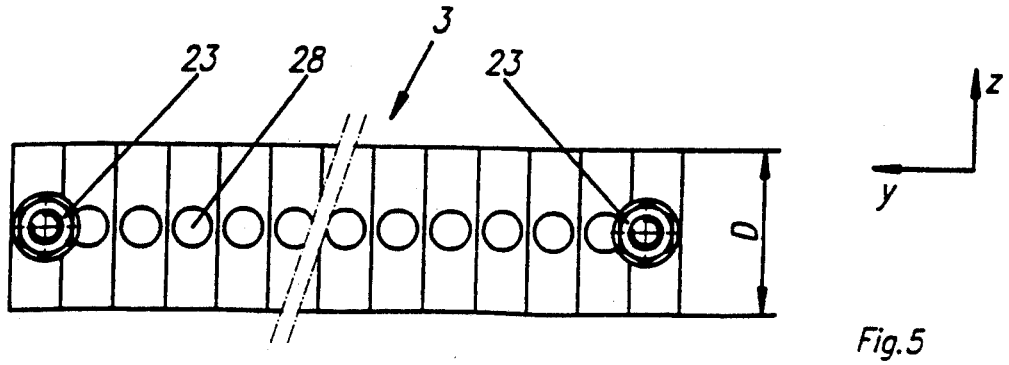
FIG. 5 is a view of the front of the cutting base, taken from direction "B" in FIG. 4.
Figure 7:
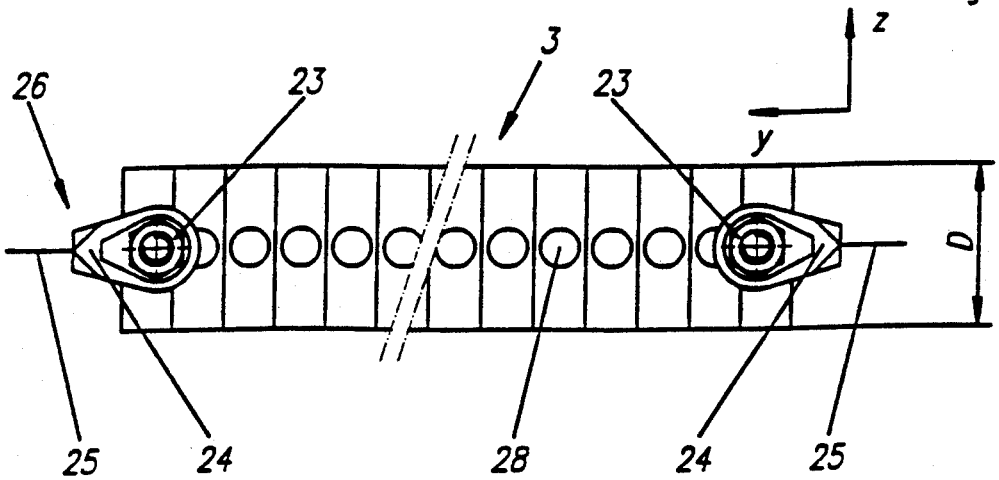
FIG. 7 is a front view of the cutting base, as seen in the direction of the arrow A in FIG. 6.
Figure 13:
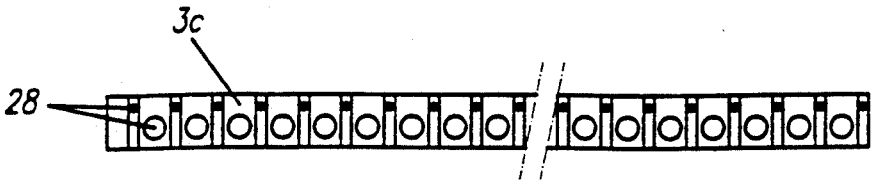
FIG. 13 is a side view of the cutting base, as seen in the direction indicated by the arrow Z in FIG. 12.

In order to improve the removal of the fluid from the fluid-jet 18, the metal strips 3*a*, 3*b*, 3*c* can be provided with holes, distributed over their length y, so that the fluid can discharge not only through that undulation valley T into which it enters directly but also through the adjacent undulation valleys. This is particularly suitable when a hole spacing of small diameter is desired, in which case, of course, the capillary effect limits the rate of discharge of the fluid. In FIGS. 5, 7 and 13 these holes 28 have been shown by way of example.

Figure 3A:
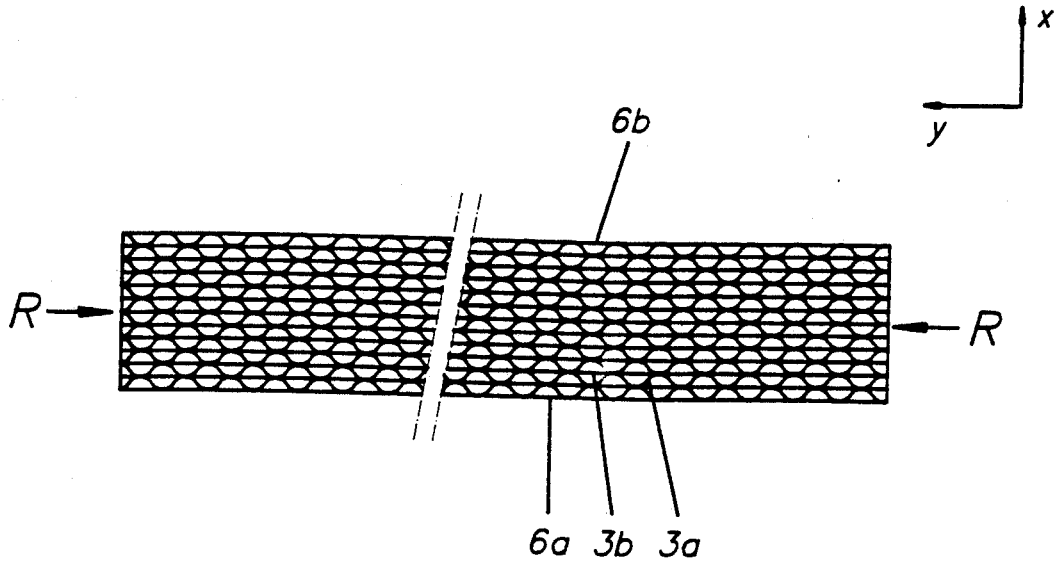
FIG. 3*a* is a general top view of the cutting base shown in FIG. 1 or FIG. 3.
Figure 3B:
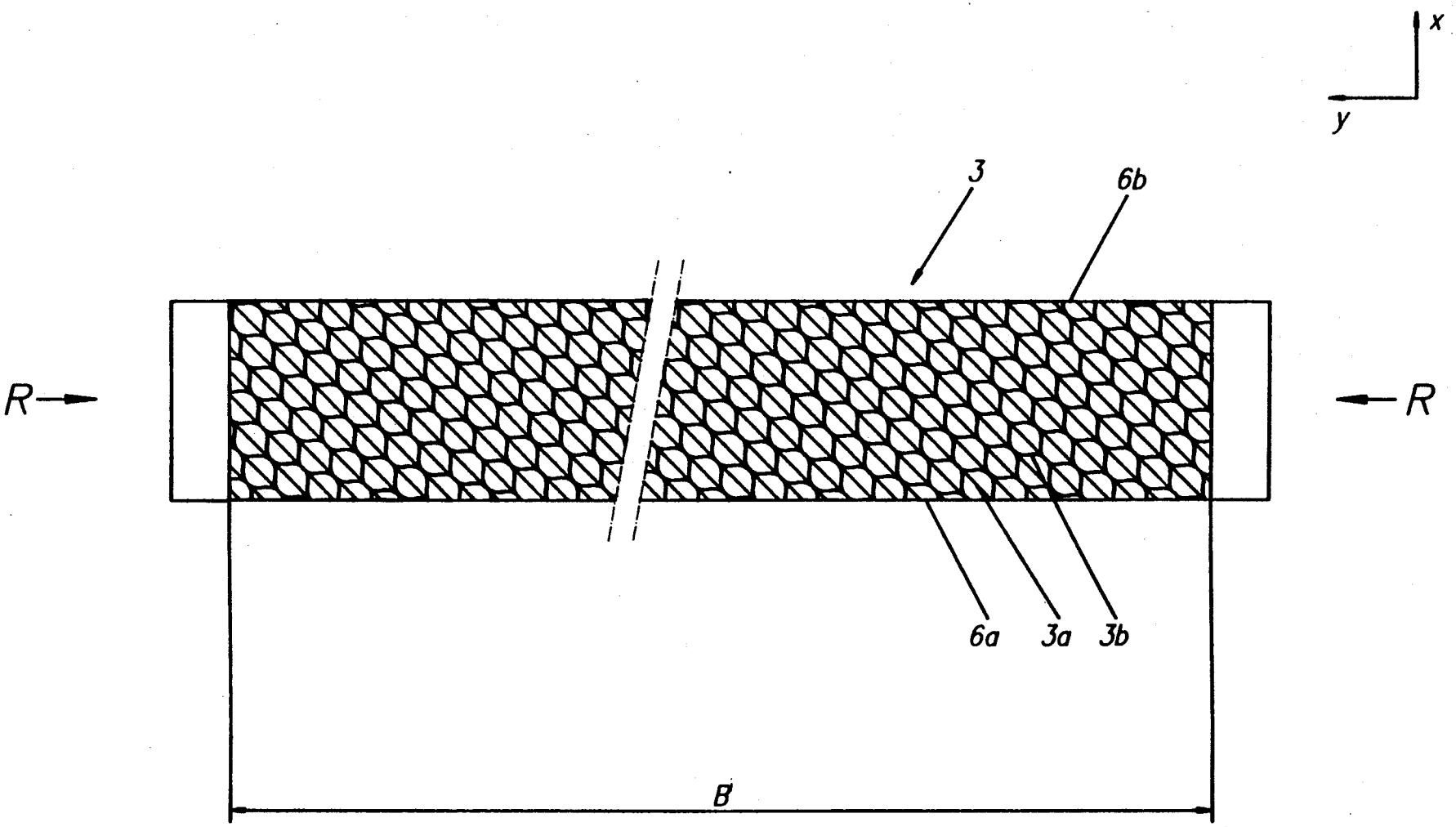
FIG. 3*b* is a general top view of a modified form of the cutting base of FIG. 1 or FIG. 3.
Figure 3:
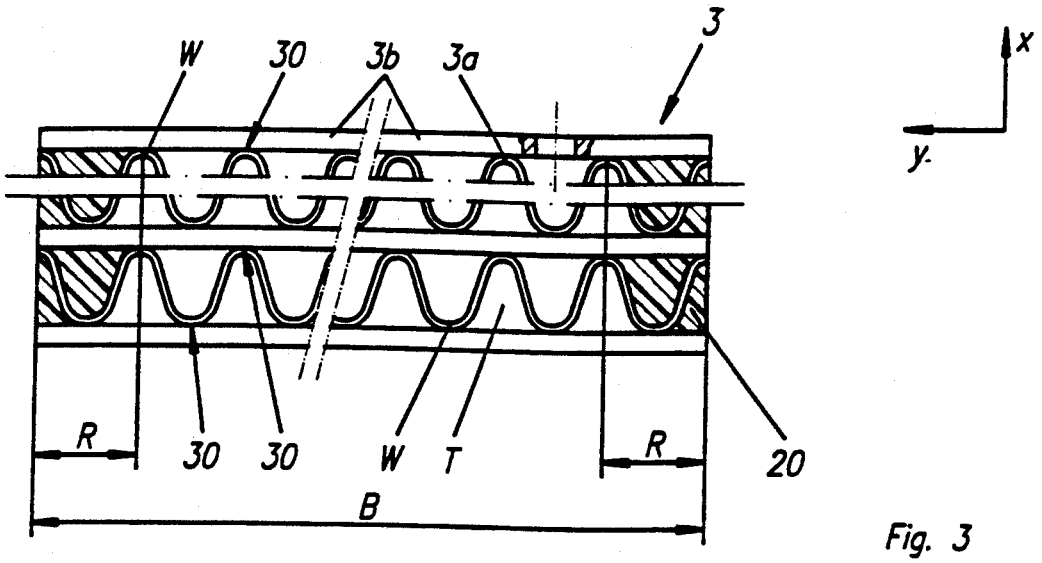
FIG. 3 is a partial top view of the cutting base, on a larger scale.

FIG. 3*a* is a general top view of the cutting base shown in FIG. 1 or FIG. 3.

FIG. 3*b* is a general top view of a modified form of the cutting base of FIG. 1 or FIG. 3, in which the metal strips do not form a right angle to the edge of the work table; i.e., the metal strips do not extend in the Y direction.

Referring again to FIG. 3, the otherwise open longitudinal edge regions R of the cutting base 3 can be grouted with a synthetic resin 20 so that a few undulation valleys T are completely filled with the synthetic resin 20. This grouting with synthetic resin 20 prevents the cutting base 3 from being broken apart. There might be a risk of this occurring if, after a lengthy period of use, the individual connecting points 30 between the metal strips 3*a* and 3*b* are repeatedly struck by the high-energy cutting jet 18 and thereby disconnected. The grouting is particularly advisable if the metal strips 3*a*, 3*b* have not been soldered to each other.

Figure 4:
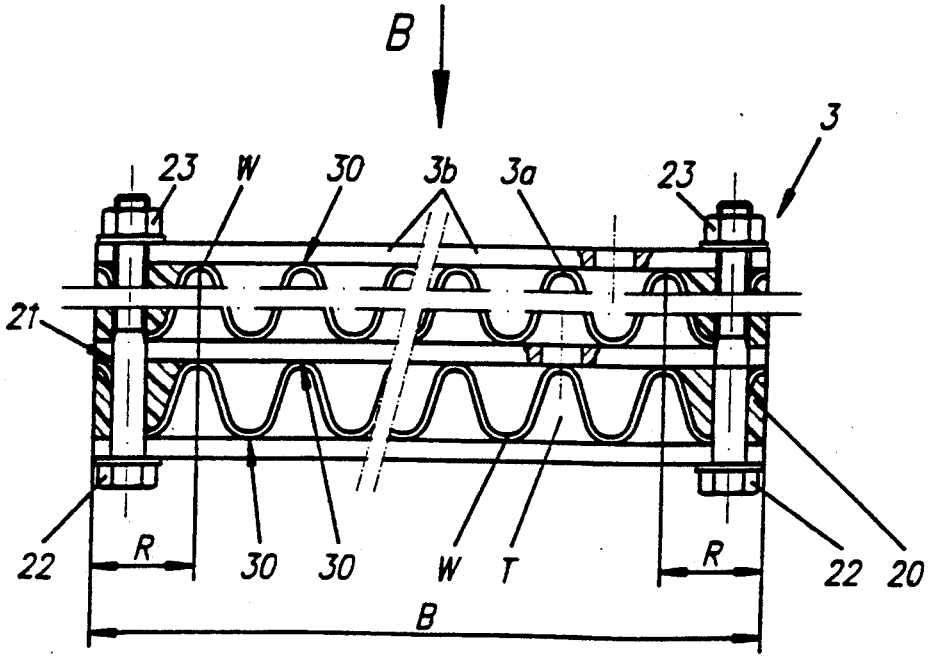
FIG. 4 shows another form of the cutting base.
Figure 6:
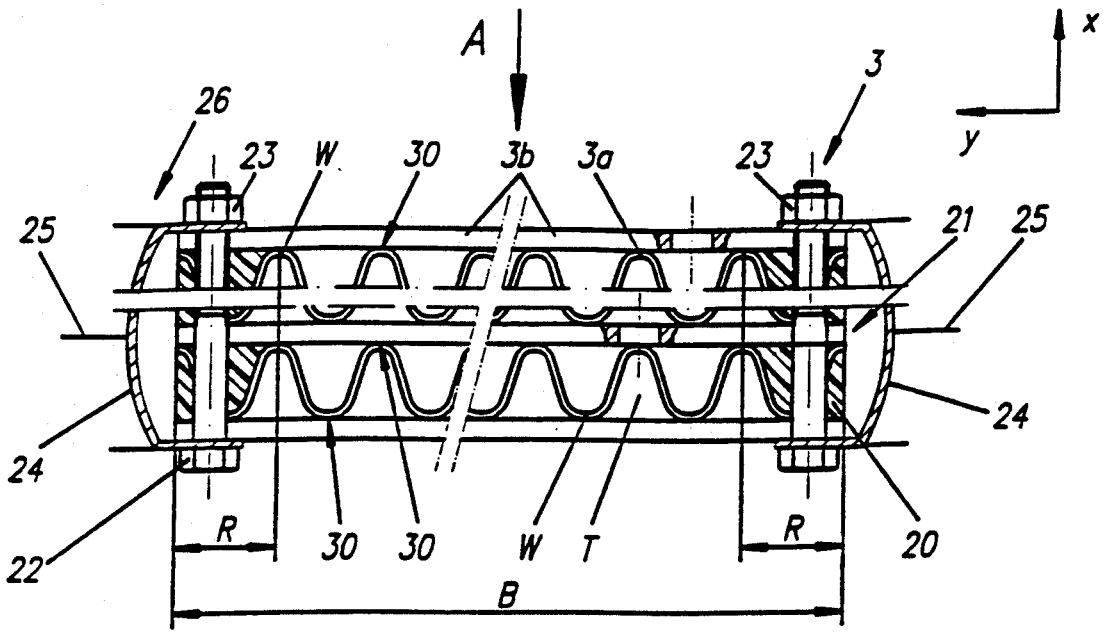
FIG. 6 shows another embodiment of the cutting base, in partial top view.

FIGS. 4 and 6 show further embodiments of the cutting base 3. For features that correspond to those in the embodiment according to FIG. 3, the same reference numbers have in part been used here since the construction already described is usable also for these embodiments.

In the embodiments of FIGS. 4 and 6, the longitudinal edge regions R of the cutting base 3, which are filled with synthetic resin 20, also have passage holes 21 into which bolts 22 can be inserted. By tightening a nut 23, a compressive stress can be produced on the cutting base 3 in the X direction. This provides additional security against the tearing of the cutting base 3 or the fraying or separating of its surface.

In the embodiment shown in FIG. 6, to further increase the life and strength of the cutting base, a tensile stress is applied in the transverse direction (y direction) to each individual metal strip 3*a*, 3*b*, in addition to the above-mentioned compressive stress. This can be done by providing tension devices 26 (for example steel wires 25 provided with eyelets 24) which are fastened to both sides of the bolts 22 within the longitudinal edges of the cutting base. These tension devices 26 are secured at their other ends to corresponding abutments, not shown in detail here, within the work table 8.

Figure 11:
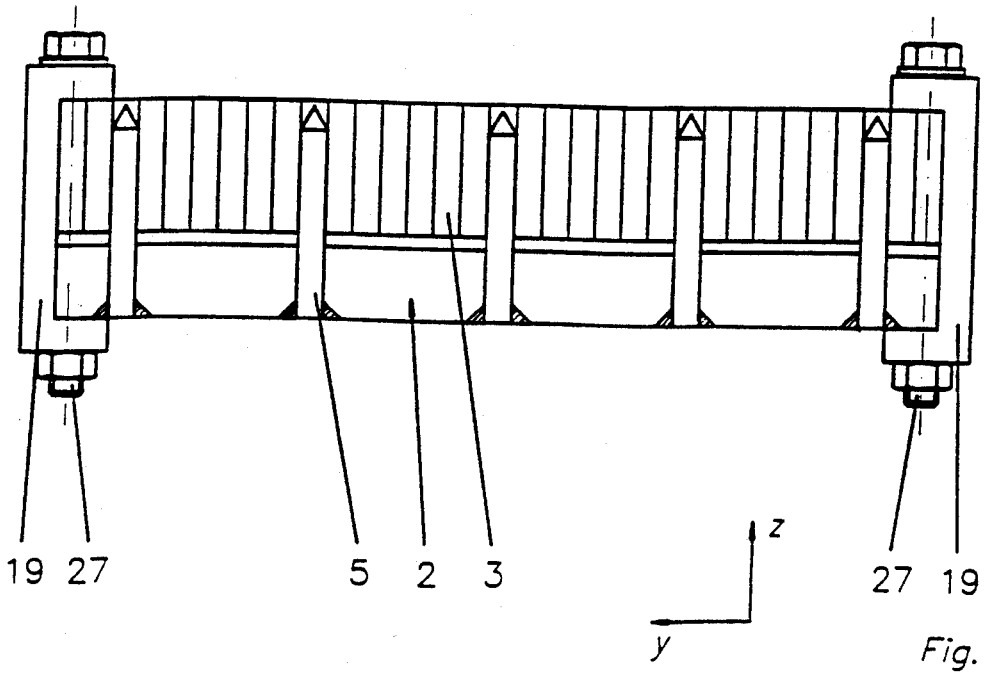
FIG. 11 is a view of a modification of the cutting base of FIG. 8.

FIG. 11 shows another possible way of fixing the cutting base 3 at its edges A C-shaped section 19 extending in the Z direction is placed around both the grid 2 and the cutting base 3 and is secured by bolts 27.

It is to be borne in mind that in FIGS. 4 and 6, only two of the metal strips 3*a*, 3*b* are shown. Actually, such a package is substantially thicker and accordingly the bolts 22 are also longer.

Figure 12:
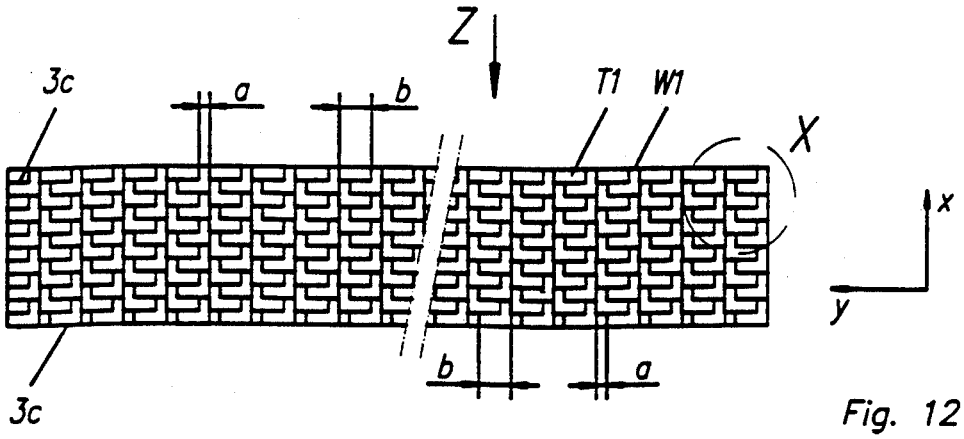
FIG. 12 is another embodiment of the cutting base of the invention.
Figure 14:
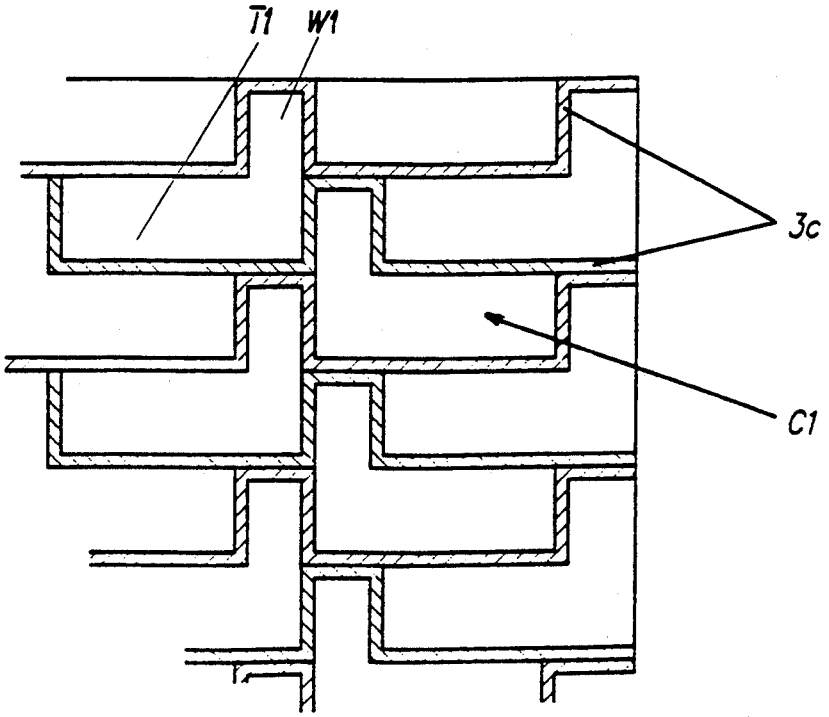
FIG. 14 is an enlargement of the portion "x" of FIG. 13.

Another embodiment of the invention is shown in FIGS. 12 and 13. Instead of the alternating arrangement of undulating and non-undulating metal strips, metal strips 3*c* having the shape of a "rectangular undulation" are used. An enlarged partial view of this shape is shown in FIG. 14. Undulation valleys T1 and undulation ridges W1 have different pitch lengths a, b. In the drawing, b=2*a*. The metal strips 3*c* are so applied against each other that, in each case, an undulation valley T1 adjoins an undulation ridge W1 forming a corner-shaped open region C1. The connection between the individual metal strips 3*c* can be effected by gluing, soldering or any other of the methods described above. This embodiment has the advantage that only one type of metal strip need be used, which decreases the cost of manufacture. These "rectangular undulations" 3*c* can be placed on a grid with bolts in the same way as already described. Similarly, it is also possible here to provide the strips with holes 28 in their lengthwise direction y perpendicular to the vertical direction of installation so as to improve the removal of water by their capillarity.

The cutting base 3, instead of resting on granulate-filled cages 16, can also rest on a substructure, not shown here, of tensioned and braced metal strips. In such case, parallel straight metal strips are clamped at a distance from each other in the longitudinal direction in a metal frame. Other metal strips have slits at a distance apart equal to the distance between the clamped metal strips so that the former can be placed on the latter in transverse direction. The cutting base 3 can then be placed on top of this. If the metal strips described above are sufficiently wide, the grids 15 which are arranged above the collecting pan 4 could also be dispensed with.

When individual segments are placed together to form a cutting base 3, the cutting base 3 can also take the form of a rotating conveyor belt. In this case, the individual segments are pivoted to each other so that the conveyor belt can bend and change direction at guide rollers which are arranged in front of and behind the work table 8. The guide rollers may also serve as the drive. The development of this general concept of a "conveyor belt" has been known for a long time and therefore does not require any special description.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A work table for a very-high-pressure fluid-jet cutting installation, having a metallic cutting base which has an upper interrupted surface for supporting a material to be cut, wherein the upper interrupted surface is formed by respective upper edges of a plurality of individual metal strips arranged extending one alongside the other, some of said metal strips having undulations in the plane of said cutting base, wherein said plurality of metal strips comprises undulating metal strips and non-undulating metal strips disposed alternately and in contact with each other.

2. A work table for a very-high-pressure fluid-jet cutting installation, having a metallic cutting base which has an upper interrupted surface for supporting a material to be cut, wherein the upper interrupted surface is formed by respective upper edges of a plurality of individual metal strips arranged extending one alongside the other, some of said metal strips having undulations in the plane of said cutting base, wherein said plurality of metal strips comprises substantially exclusively metal strips which are bent in the form of a rectangular undulation, each strip defining an undulation ridge having a length which differs from a length of an undulation valley of said strip.

3. A work table according to claim 2, wherein the undulation ridges of each two adjacent undulating strips are offset with respect to each other.

4. A work table according to claim 3, wherein undulation ridges of a plurality of metal strips, together with corresponding undulation valleys of adjacent metal strips, form corner-shaped interruptions in the upper surface of the cutting base.

5. A work table according to claim 1, wherein said undulating metal strips are bonded to said non-undulating metal strips at undulation ridges thereof.

6. A work table according to claim 2, wherein said adjacent metal strips are bonded together.

7. A work table according to claim 6, wherein said adjacent metal strips are soldered together.

8. A work table according to claim 1 or claim 2, wherein the metal strips are supported on bolts which extend upwardly from a substructure of said cutting base.

9. A work table according to claim 8, wherein said bolts are arranged on outer struts forming the longitudinal sides of the cutting base, at the points of intersection of longitudinal and transverse struts of a grid, and extend upward above the grid.

10. A work table according to claim 9, wherein an undulating metal strip rests against an adjacent bolt with the latter partially surrounded by an undulation valley of said metal strip.

11. A work table according to claim 1 or claim 2, wherein edge regions of said cutting base which are defined to be perpendicular to the lengthwise direction of the metal strips are grouted with a synthetic resin.

12. A work table according to claim 1 or claim 2, further comprising means for applying a continuously acting compressive stress to the cutting base substantially perpendicular to the lengthwise direction of the metal strips 13. A work table according to claim 12, wherein the metal strips have respective bolt holes and the compressive stress is applied by bolt means inserted through said bolt holes.

14. A work table according to claim 1 or 2 further comprising C-shaped clamping means extended across an edge region of said cutting base in a direction substantially perpendicular to said cutting base.

15. A work table according to claim 12, further comprising means for applying a continuously acting tensile stress in the lengthwise direction of said metal strips 16. A work table according to claim 15, wherein the metal strips have respective bolt holes and bolt means inserted therein; and said tensile stress is applied by means attached to said bolt means.

17. A work table according to claim 1 or claim 2, wherein the cutting base has a longitudinal direction corresponding to edges of the work table and the metal strips have another longitudinal direction which extends at an angle other than a right angle to the edges of the work table.

18. A work table according to claim 1 or claim 2, further comprising means for applying a continuously acting tensile stress in the lengthwise direction of said metal strips.

19. A work table according to claim 18, wherein the metal strips have respective bolt holes and bolt means inserted therein; and said tensile stress is applied by means attached to said bolt means.

* * * * *